US011253899B2

(12) United States Patent
Mardani et al.

(10) Patent No.: US 11,253,899 B2
(45) Date of Patent: Feb. 22, 2022

(54) PRODUCTION OF REINFORCED DOUBLE-LAYER PARTS

(71) Applicants: Alireza Mardani, Najafabad (IR); Majid Hashemzadeh, Isfahan (IR)

(72) Inventors: Alireza Mardani, Najafabad (IR); Majid Hashemzadeh, Isfahan (IR)

( * ) Notice: Subject to any disclaimer, the term of this patent is extended or adjusted under 35 U.S.C. 154(b) by 140 days.

(21) Appl. No.: 16/289,673

(22) Filed: Mar. 1, 2019

(65) Prior Publication Data

US 2019/0217365 A1 Jul. 18, 2019

Related U.S. Application Data

(60) Provisional application No. 62/636,842, filed on Mar. 1, 2018.

(51) Int. Cl.
*B21D 22/28* (2006.01)
*B21D 37/10* (2006.01)
(Continued)

(52) U.S. Cl.
CPC ..... *B21D 22/28* (2013.01); *B21D 22/203* (2013.01); *B21D 22/21* (2013.01); *B21D 35/007* (2013.01);
(Continued)

(58) Field of Classification Search
CPC ..... B21D 22/20; B21D 22/21; B21D 22/28; B21D 22/203; B21D 51/00; B21D 51/02;
(Continued)

(56) References Cited

U.S. PATENT DOCUMENTS 1,385,357 A * 7/1921 Bellamore ..... B21D 51/10 29/888.05
1,908,162 A * 5/1933 Mihay ..... B21D 53/00 72/348
(Continued)

FOREIGN PATENT DOCUMENTS

DE 961053 C * 3/1957 ..... B65D 3/12
JP 57025218 A * 2/1982
(Continued)

OTHER PUBLICATIONS

Rudolf Pernis, Evaluation of limiting drawing ratio (LDR) in deep drawing process, Jan. 2015, Acta Metallurgica Slovaca (Year: 2015).*

*Primary Examiner* — Debra M Sullivan
*Assistant Examiner* — Dylan Schommer
(74) *Attorney, Agent, or Firm* — Bajwa IP Law Firm; Haris Zaheer Bajwa

(57) ABSTRACT

A method for fabricating a double layer cup-shaped part may include shaping a first material into a hollow cylinder, mounting the hollow cylinder on a draw punch, where the draw punch may include an upper punch portion with a first diameter and a lower punch portion with a second smaller diameter. Mounting the hollow cylinder on the draw punch may include tightly fitting the hollow cylinder around the lower punch portion. The method may further include forming the double layer cup-shaped part by drawing a blank material through a draw die by placing the blank material over an upper opening of the draw die, and pressing the draw punch over the blank material. The first material may form an inner layer of the double layer cup-shaped part and the blank material may form an outer cup-shaped layer of the double layer cup-shaped part.

11 Claims, 15 Drawing Sheets

(51) Int. Cl.

| | |
|---|---|
| ***B21D 51/26*** | (2006.01) |
| ***B21D 51/10*** | (2006.01) |
| ***B21D 22/21*** | (2006.01) |
| ***B21D 22/20*** | (2006.01) |
| ***B21D 35/00*** | (2006.01) |

(52) U.S. Cl.
CPC ..... *B21D 37/10* (2013.01); *B21D 51/10* (2013.01); *B21D 51/26* (2013.01)

(58) Field of Classification Search
CPC .... B21D 51/26; B21D 49/005; B21D 35/007; B21D 51/10; B21D 37/14; B21D 37/154; B21D 37/16; B21D 37/185; B23P 11/00; B23P 11/005; Y10T 29/49909; Y10T 29/49913; Y10T 29/49924; B21C 37/154; B29C 55/30; B31B 2120/402; B31B 2120/406; B65B 3/022; B65B 43/08; B65B 47/00; B65B 47/04; B65B 47/06
USPC ..... 72/267, 347–349, 363, 462, 476; 264/323
See application file for complete search history.

(56) References Cited

U.S. PATENT DOCUMENTS

| | | | | | |
|---|---|---|---|---|---|
| 2,490,926 | A | * | 12/1949 | Slater | B21D 22/21 72/336 |
| 3,042,428 | A | * | 7/1962 | Gardiner | B32B 15/017 285/148.12 |
| 3,169,302 | A | * | 2/1965 | Tethal | B21D 53/10 29/898.054 |
| 4,562,719 | A | * | 1/1986 | Budrean | B21D 51/54 72/349 |
| 5,271,142 | A | * | 12/1993 | Moore, III | B21D 22/205 29/469.5 |

FOREIGN PATENT DOCUMENTS

| | | | | | |
|---|---|---|---|---|---|
| JP | 57118826 | A | * | 7/1982 | B21D 22/28 |
| JP | 57137038 | A | * | 8/1982 | B21D 53/84 |
| JP | 58135732 | A | * | 8/1983 | B21D 22/21 |

* cited by examiner

PRODUCTION OF REINFORCED DOUBLE-LAYER PARTS

CROSS-REFERENCE TO RELATED APPLICATION

This application claims the benefit of priority from U.S. Provisional Patent Application Ser. No. 62/636,842, filed on Mar. 1, 2018, and entitled "MANUFACTURING REINFORCED DOUBLE-LAYER BUSHINGS THROUGH TRACTRIX DIES," which is incorporated herein by reference in its entirety.

TECHNICAL FIELD

The present disclosure relates to shaping parts by drawing, and particularly relates to shaping double layer parts by drawing.

BACKGROUND

In shaping processes involving deep drawing, a plate-like blank material may be formed into a cylindrical or box-shaped part by utilizing a draw punch that presses the blank material in a draw die cavity. Conical and tractrix draw dies allow for carrying out the deep drawing process without a blank material holder and yet avoiding risk of wrinkling in a final part. Deep drawing process is a cost-effective production method for shaping and producing cup-shaped parts out of formable materials, such as formable metals like aluminum, copper, steel, and brass.

Given the importance of producing double layer bi-metal high-pressure reservoirs and other similar double layer bi-metal cup-shaped parts, a cost-effective shaping method such as deep drawing may be utilized for producing reinforced double layer parts. There is a need for methods and devices that may allow for producing double layer reinforced cup-shaped parts by utilizing a deep drawing process.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure is directed to a method for fabricating a double layer cup-shaped part. The exemplary method may include shaping a first material into a hollow cylinder, mounting the hollow cylinder on a draw punch, where the draw punch may include an upper punch portion with a first diameter and a lower punch portion with a second smaller diameter. Mounting the hollow cylinder on the draw punch may include tightly fitting the hollow cylinder around the lower punch portion. The exemplary method may further include forming the double layer cup-shaped part by drawing a blank material through a draw die by placing the blank material over an upper opening of the draw die, and pressing the draw punch over the blank material. The first material may form an inner layer of the double layer cup-shaped part and the blank material may form an outer cup-shaped layer of the double layer cup-shaped part.

In an exemplary embodiment, shaping the first material into the hollow cylinder may include shaping the first material into a hollow cylinder with an inner diameter equal to the second smaller diameter.

In an exemplary embodiment, shaping the first material into the hollow cylinder may include shaping the first material into a hollow cylinder with an outer diameter equal to or less than the first diameter.

In an exemplary embodiment, shaping the first material into the hollow cylinder may include shaping the first material into a hollow cylinder with a height equal to a height of the lower punch portion. In an exemplary embodiment, shaping the first material into the hollow cylinder may include machining the hollow cylinder out of the first material.

In an exemplary embodiment, placing the blank material over the upper opening of the draw die may include placing the blank material over a draw die with an upper die surface with a wide flare. In an exemplary embodiment, placing the blank material over the upper opening of the draw die may include placing the blank material over a draw die with an upper die surface with a tractrix flare.

In an exemplary embodiment, placing the blank material over the upper opening of the draw die may include placing the blank material over the draw die, the draw die further comprising a straight lower die surface immediately below the upper die surface.

In an exemplary embodiment, shaping the first material into the hollow cylinder may include shaping a first formable metal into the hollow cylinder, where the first formable metal may be one of brass, copper, aluminum, and stainless steel.

In an exemplary embodiment, placing the blank material over the upper opening of the draw die may include placing a second formable metal over the upper opening of the draw die, where the second formable metal may be one of brass, copper, aluminum, and stainless steel.

According to one or more exemplary embodiments, the present disclosure is directed to an apparatus for forming a double layer part with an inner cylindrical layer and an outer cup-shaped layer. The exemplary apparatus may include a draw punch that may include an upper punch portion with a first diameter and a lower punch portion with a second diameter, the second diameter may be smaller than the first diameter. The second smaller diameter may be equal to an inner diameter of the inner cylindrical layer. The exemplary apparatus may further include a draw die with an upper die cavity, where the upper die cavity may include an upper die surface with a wide flare, and a pressing mechanism that may be configured to press the draw punch into the draw die.

In an exemplary embodiment, the draw die may further include a lower die cavity immediately below the upper die cavity, where the lower die cavity may include a straight lower die surface.

In an exemplary embodiment, the draw die may further include a stripping cavity immediately below the lower die cavity, the stripping cavity comprising a cylindrical cavity with a diameter larger than a diameter of the lower die cavity.

In an exemplary embodiment, the lower punch portion may have a height equal to a height of the inner cylindrical layer. In an exemplary embodiment, the first diameter may be equal to an outer diameter of the inner cylindrical layer.

In an exemplary embodiment, the upper die portion may further include a shoulder encircling an upper opening of the upper die cavity, the shoulder configured to support a blank material over the upper opening of the upper die cavity. In an exemplary embodiment, the pressing mechanism may further be configured to press the draw punch over the blank material into the draw die.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
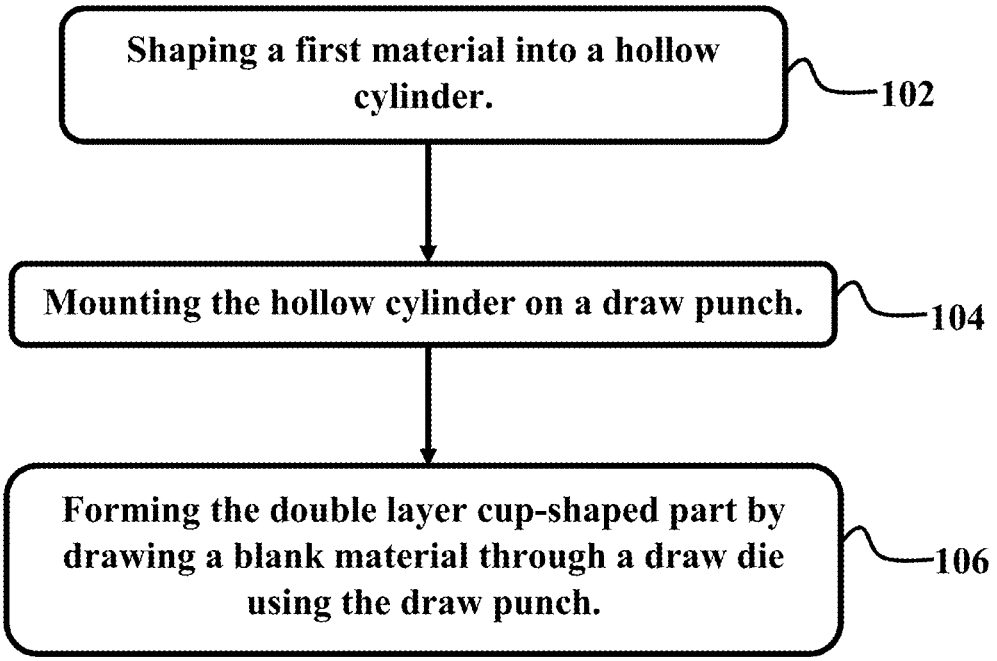
FIG. 1 illustrates a method for forming a double layer cup-shaped part, consistent with one or more exemplary embodiments of the present disclosure.

In the following detailed description, numerous specific details are set forth by way of examples to provide a thorough understanding of the relevant teachings related to the exemplary embodiments. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be plain to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

The present disclosure is directed to methods and devices for forming double layer cup-shaped parts. The exemplary methods and devices utilize a drawing process for forming a double layer part with an inner cylindrical layer and an outer cup-shaped layer, where the inner cylindrical layer and the outer cup-shaped layer may be made of different materials. The exemplary methods may include shaping the inner cylindrical layer out of a first formable material such as a formable metal, mounting the inner cylindrical layer on a draw punch, and then using the draw punch to draw a circular blank made of a second formable material such as a second formable metal through a draw die. In the exemplary methods, drawing the circular blank through the draw die may be carried out by pressing the draw punch onto the circular blank over the draw die. The descending draw punch may initially deform the circular blank to fit the blank into a contour of an upper surface of the draw die. As the draw punch continues to move down, the draw punch may pull the blank through a lower die cavity with a straight surface to form a cup with straight side walls. In exemplary methods and devices, as an exemplary draw punch pulls an exemplary blank through an exemplary draw die, inner cylindrical layer may be attached to an inner surface of the cup-shaped outer layer due to pressure exerted on the inner cylindrical layer and the outer cup-shaped layer during the drawing process.

FIG. 1 illustrates a method 100 for forming a double layer cup-shaped part, consistent with one or more exemplary embodiments of the present disclosure. In an exemplary embodiment, method 100 may include a step 102 of shaping a first material into a hollow cylinder, a step 104 of mounting the hollow cylinder on a draw punch, and a step 106 of forming the double layer cup-shaped part by drawing a blank material through a draw die utilizing the draw punch.

In an exemplary embodiment, step 104 of mounting the hollow cylinder on a draw punch may include mounting the hollow cylinder on a draw punch that may include an upper punch portion with a first diameter and a lower punch portion with a second diameter. In an exemplary embodiment the second diameter may be smaller than the first diameter. In an exemplary embodiment, mounting the hollow cylinder on the draw punch may include tightly fitting the hollow cylinder around the lower punch portion.

In an exemplary embodiment, step 102 of shaping the first material into the hollow cylinder with a predetermined thickness may include shaping the first material into a hollow cylinder with an inner diameter equal to the second smaller diameter and an outer diameter equal or less than the first diameter. In an exemplary embodiment, the hollow cylinder may have a height equal to a height of the lower punch portion such that a lower base end of the hollow cylinder may lie flush against a lower base end of the draw punch. In an exemplary embodiment, the hollow cylinder may be formed by a shaping method such as machining the hollow cylinder out of the first material. In an exemplary embodiment, the first material may include a formable material such as a formable metal that may be one of brass, copper, aluminum, or steel.

In an exemplary embodiment, step 106 of forming the double layer cup-shaped part by drawing a blank material through a draw die my include placing the blank material over the draw die and then pressing down the draw punch over the blank material such that the descending draw punch may first deform the blank material to fit into an opening of the draw die and then may pull the blank material through the draw die to form the outer cup-shaped layer. In an exemplary embodiment, the opening of the draw die may have an upper die surface with a wide flare. In an exemplary embodiment, the upper die surface may include a tractrix flare or surface. As used herein, a tractrix flare or surface may refer to a surface with a tractrix curvature similar to a tractrix horn.

In an exemplary embodiment, in step 106 of forming the double layer cup-shaped part by drawing the blank material through the draw die, as the draw punch deforms the blank material and draws the blank material through the draw die, the inner cylindrical layer mounted on the punch may attach to an inner surface of the outer cup-shaped layer under or due to the axial pressure of the drawing process exerted by an inner surface of the draw die and an outer surface of the lower punch portion onto the inner cylindrical layer and the outer cup-shaped layer. The aforementioned axial pressure may press the inner cylindrical layer and the outer cup-shaped layer together to form the double layer cup-shaped part. In an exemplary embodiment, the blank material may include a formable material such as a formable metal that may be one of brass, copper, aluminum or steel.

Figure 2A:
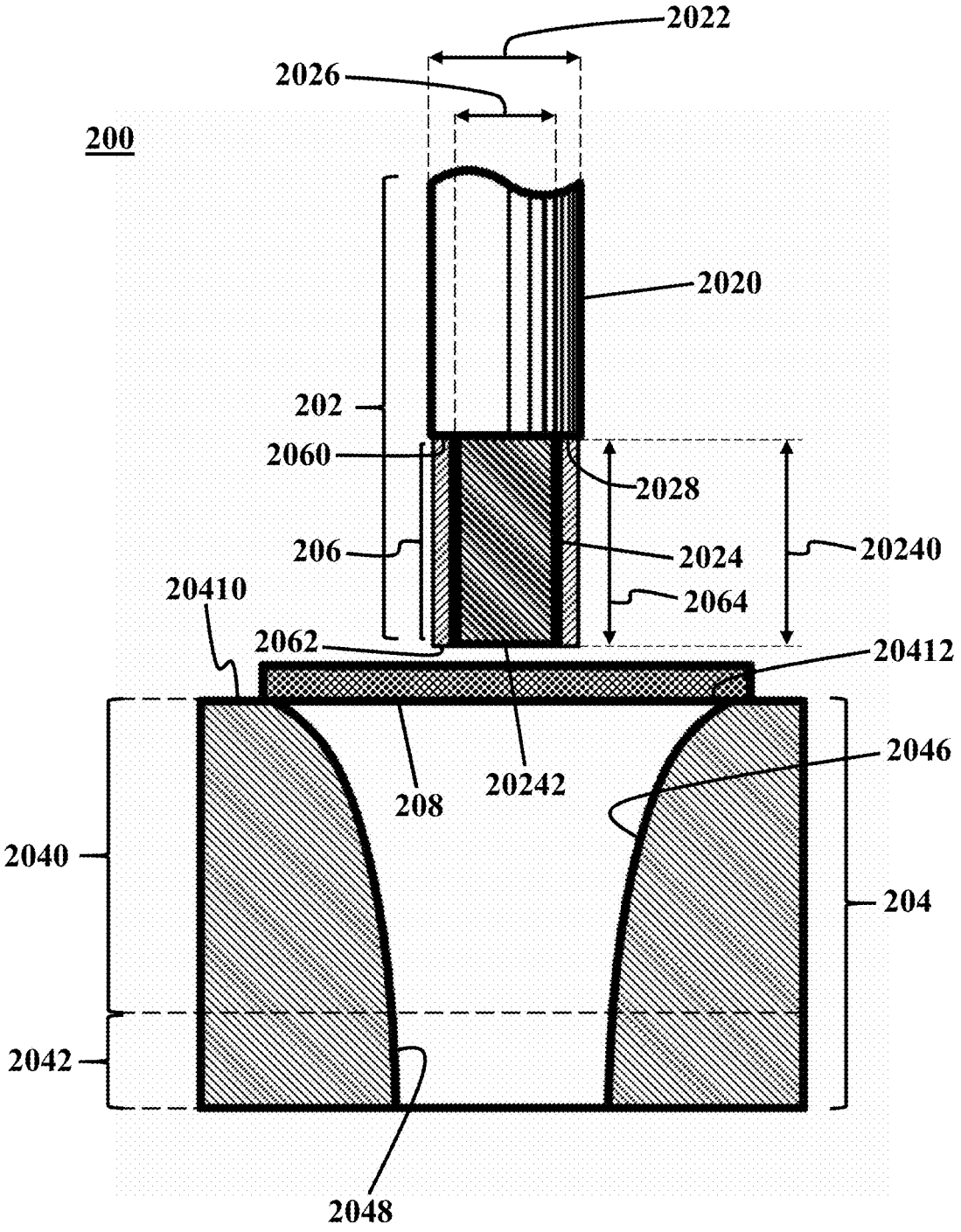
FIGS. 2A-2C illustrate an apparatus for forming a double layer cup-shaped part during an exemplary drawing process, consistent with one or more exemplary embodiments of the present disclosure.
Figure 2B:
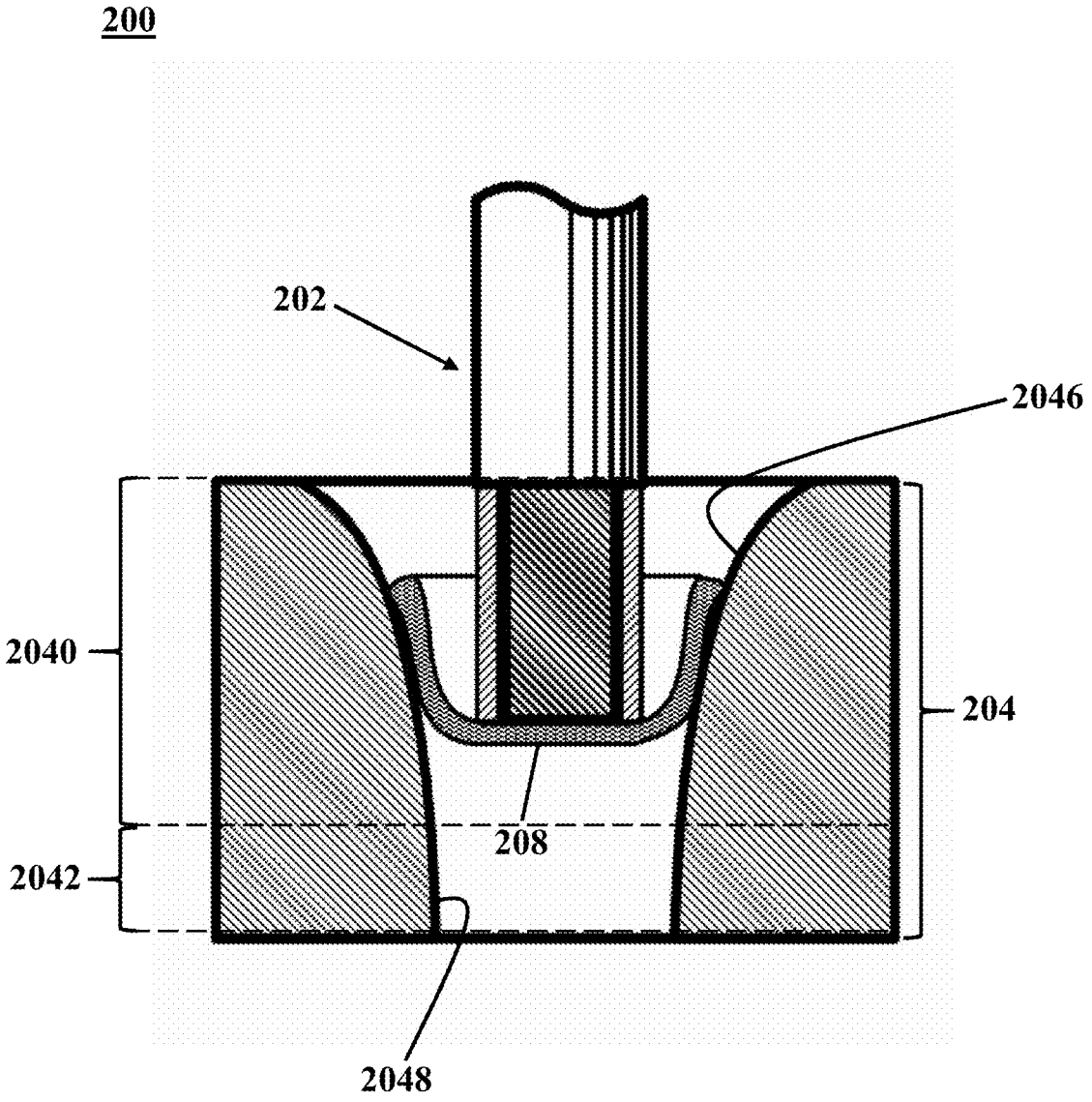
Figure 2C:
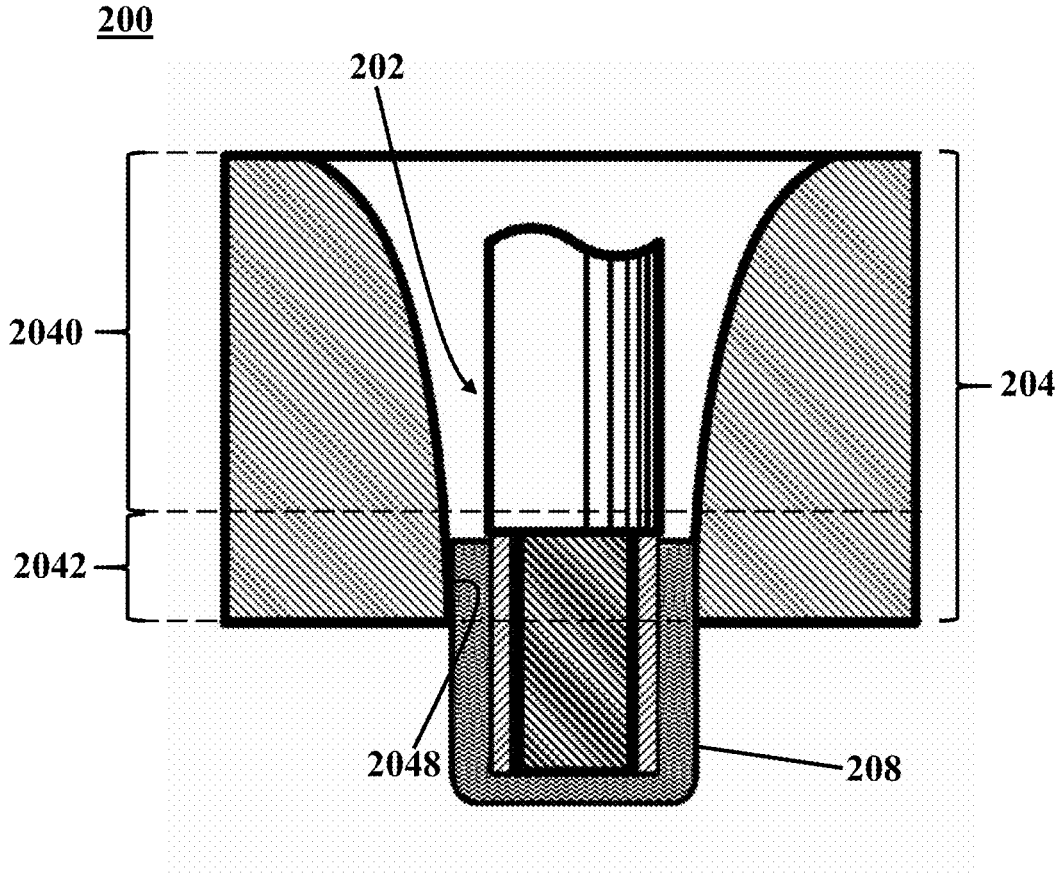

FIGS. 2A-2C illustrate an apparatus 200 for forming a double layer cup-shaped part during an exemplary drawing process, consistent with one or more exemplary embodiments of the present disclosure. In an exemplary embodiment, apparatus 200 may be utilized for implementing method 100.

In an exemplary embodiment, apparatus 200 may include a draw punch 202 that may be positioned above and vertically aligned with a draw die 204. In an exemplary embodiment, draw punch may include an upper punch portion 2020 with a first diameter 2022 and a lower punch portion 2024 with a second smaller diameter 2026 such that a shoulder 2028 may be defined between upper punch portion 2020 and lower punch portion 2024.

In an exemplary embodiment, draw die 204 may include an upper die cavity 2040 and a lower die cavity 2042. Upper die cavity 2040 may include an upper die surface 2046 with a wide flare and lower die cavity 2042 may include a straight vertical surface 2048 that may function as an ironing section of draw die 204. In an exemplary embodiment, upper die surface 2046 may include a tractrix flare or surface similar to a tractrix horn.

Referring to FIGS. 1 and 2A-2D, in an exemplary embodiment, step 102 may involve shaping a first material into a hollow cylinder. For example, a hollow cylinder 206 may be shaped out of a first material with an inner diameter of approximately equal to second smaller diameter 2026 such that hollow cylinder 206 may be tightly fitted around lower punch portion 1024. Hollow cylinder 206 may have an outer diameter equal or less than first diameter 2022.

In an exemplary embodiment, step 104 may involve mounting the hollow cylinder on a draw punch, for example, hollow cylinder 206 may be tightly mounted and fit around lower punch portion 2024 such that an upper end surface 2060 of hollow cylinder may engage with shoulder 2028 and a lower end surface 2062 of hollow cylinder 206 may lie flush against a lower surface 20242 of lower punch portion 2024. In an exemplary embodiment, a height 2064 of hollow cylinder 206 may be equal to a height 20240 of lower punch portion 2024.

In an exemplary embodiment, step 106 may involve forming the double layer cup-shaped part by drawing the blank material through the draw die using the draw punch. For example, draw punch 202 may be used to draw a blank material 208 through draw die 204. In an exemplary embodiment, forming the double layer cup-shaped part by drawing the blank material through the draw die may include placing the blank material over the draw die. For example, blank material 208 may be a circular plate-like blank that may be placed on an upper die shoulder 20410 encircling an upper opening 20412 of upper die cavity 2040.

In an exemplary embodiment, forming the double layer cup-shaped part by drawing the blank material through the draw die may further include pressing the draw punch over the blank material. For example, draw punch 202 may be pressed over blank material 208 such that draw punch 202 may land on a center of blank material 208. Pressing down draw punch 202 may initially deform blank material 208 to fit blank material 208 into the contour of an upper die surface 2046 (FIG. 2B) and assume a cup-like shape under pressure. As draw punch 202 continues to move down, draw punch 202 may further pull blank material 208 through lower die cavity 2042, where straight vertical surface 2048 allows for straightening or ironing sidewalls of cup-shaped blank material 208 to form a cup with straight sidewalls (FIG. 2C).

Figure 3:
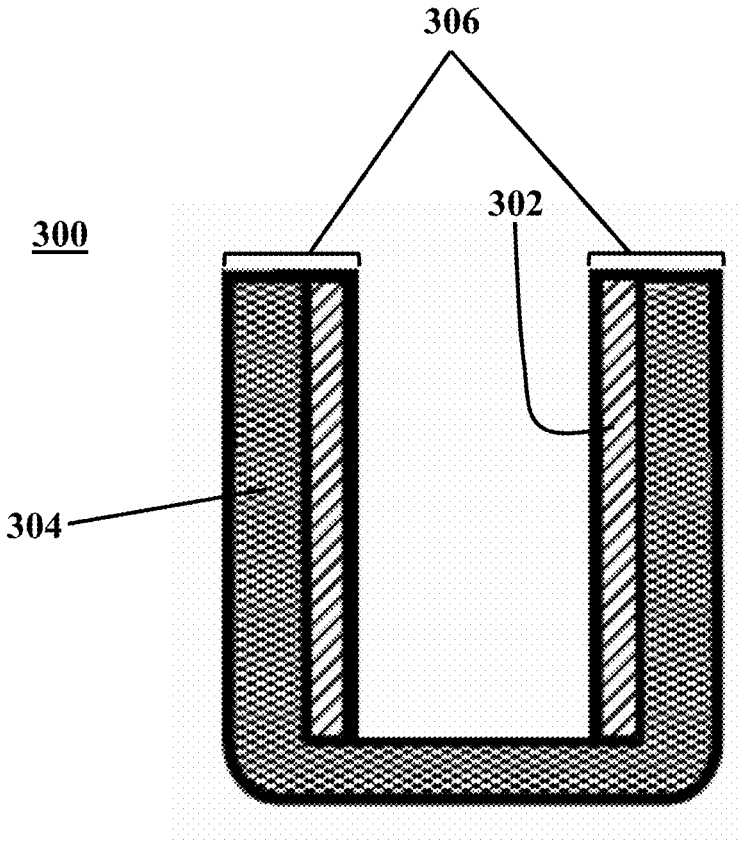
FIG. 3 illustrates a double layer cup-shaped part, consistent with one or more exemplary embodiments of the present disclosure.

FIG. 3 illustrates a double layer cup-shaped part 300, consistent with one or more exemplary embodiments of the present disclosure. In an exemplary embodiment, double layer cup-shaped part 300 may be formed by method 100 utilizing apparatus 200. In an exemplary embodiment, As draw punch 202 presses and pulls blank material 208 through draw die 204, hollow cylinder 206 may attach to an inner surface of cup-shaped blank material 208. In an exemplary embodiment, cup-shaped part 300 may include an inner layer 302 that may be formed by hollow cylinder 206 and an outer cup-shaped layer 304 that may be formed by cup-shaped blank material 208.

Figure 4A:
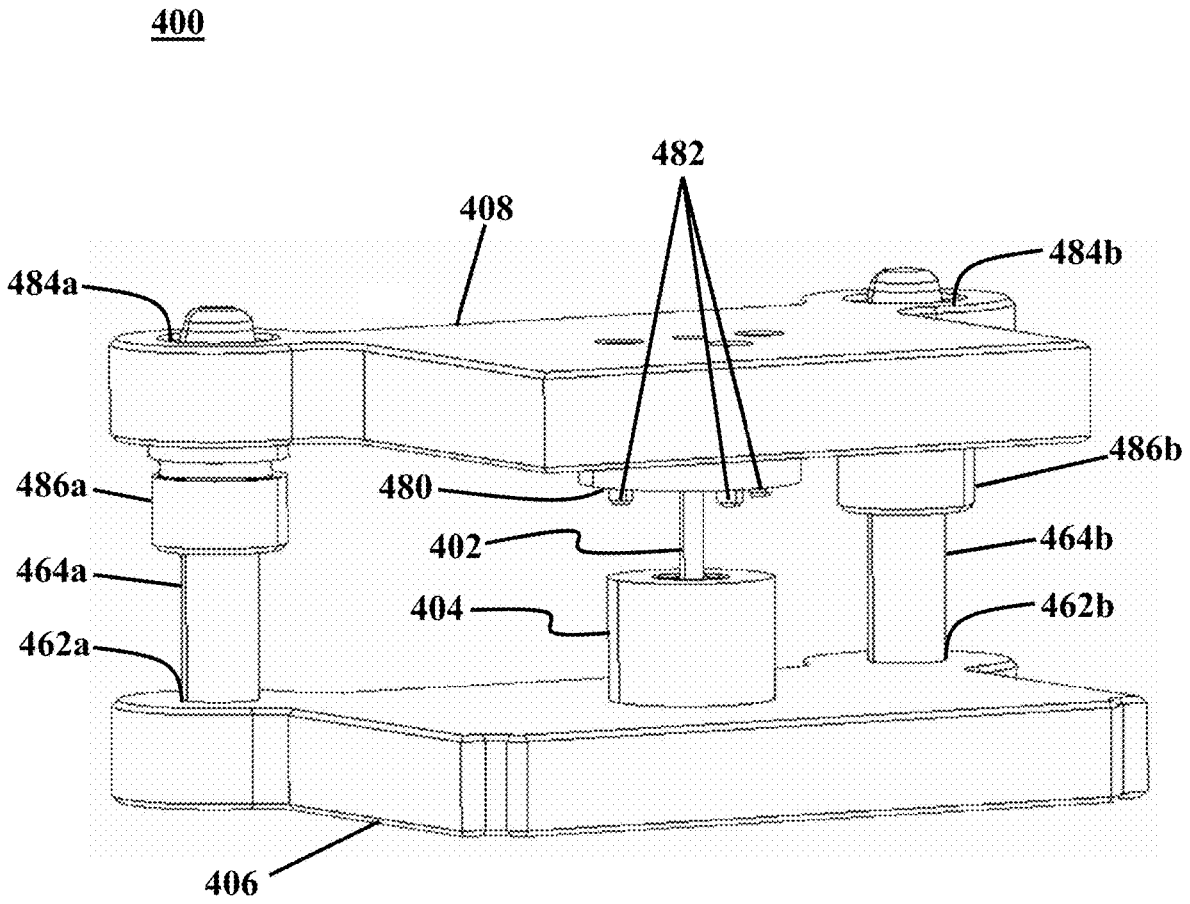
FIG. 4A illustrates a perspective view of an apparatus for forming a double layer cup-shaped part, consistent with one or more exemplary embodiments of the present disclosure.
Figure 4B:
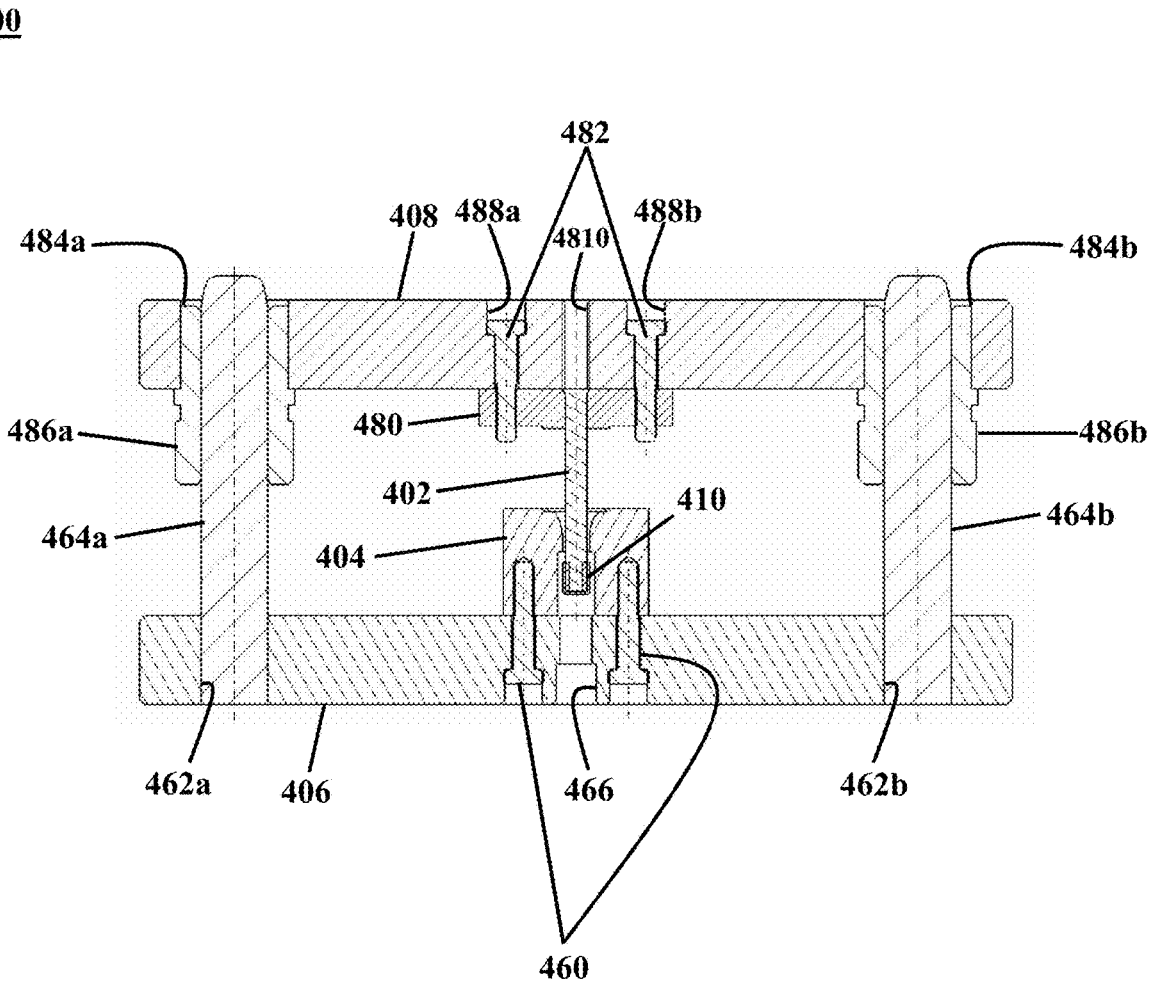
FIG. 4B illustrates a sectional side-view of an apparatus for forming a double layer cup-shaped part, consistent with one or more exemplary embodiments of the present disclosure.

FIG. 4A illustrates a perspective view of an apparatus 400 for forming a double layer cup-shaped part, consistent with one or more exemplary embodiments of the present disclosure. FIG. 4B illustrates a sectional side-view of apparatus 400, consistent with one or more exemplary embodiments of the present disclosure. In an exemplary embodiment, apparatus 400 may be similar to apparatus 200 and may be utilized for implementing method 100.

In an exemplary embodiment, apparatus 400 may include a draw punch 402 similar to draw punch 202 that may be positioned above and vertically aligned with a draw die 404 similar to draw die 204. In an exemplary embodiment, apparatus 400 may further include a lower die shoe 406 and an upper die shoe 408 that may be supported for vertical motion over lower die shoe 406. In an exemplary embodiment, upper die shoe 408 may include a retaining member 480 attached to a lower surface of upper die shoe 408 by a number of screws 482 or other fastening members. In an exemplary embodiment, retaining member 480 may be utilized for fastening draw punch 402 to upper die shoe 408 such that draw punch 402 may be vertically fixed under upper die shoe 408 without any unwanted lateral movements. In an exemplary embodiment, draw die 404 may be attached and fixed over lower die shoe 406 by a number of screws 460 or other fastening members.

In an exemplary embodiment, lower die shoe 406 may include two holes 462*a-b* in which guide posts 464*a-b* may be fixedly inserted. In an exemplary embodiment, upper die shoe 408 may further include two holes 484*a-b* in which guide bushes 486*a-b* may be fixedly inserted. In an exemplary embodiment, upper die shoe 408 may be moveably mounted on guide posts 464*a-b* by movably inserting guide posts 464*a-b* through guide bushes 486*a-b*, such that guide bushes 486*a-b* may encompass guide posts 464*a-b* and may be movable up and down along guide posts 464*a-b*. In exemplary embodiments, such arrangement of guide posts 464*a-b* and guide bushes 486*a-b* may allow for supporting upper die shoe 408 over lower die shoe 406 such that upper die shoe 408 may be moveable vertically over lower die shoe 406.

In an exemplary embodiment, apparatus 400 may be placed and fixed under a hydraulic press. The hydraulic press may exert pressure over upper die shoe 408 and upper die shoe 408 may transfer this pressure to draw punch 402. In an exemplary embodiment, draw punch 402 under the pressure of the hydraulic press may draw a blank material 410 similar to blank material 208 through draw die 408 in order to form a double layer cup-shaped part similar to double layer cup-shaped part 300. In an exemplary embodiment, upper die shoe 408 may be attached to a hydraulic press, such that the hydraulic press may press down or pull up upper die shoe along a vertical motion path defined by guide posts 464*a-b*.

Figure 4C:
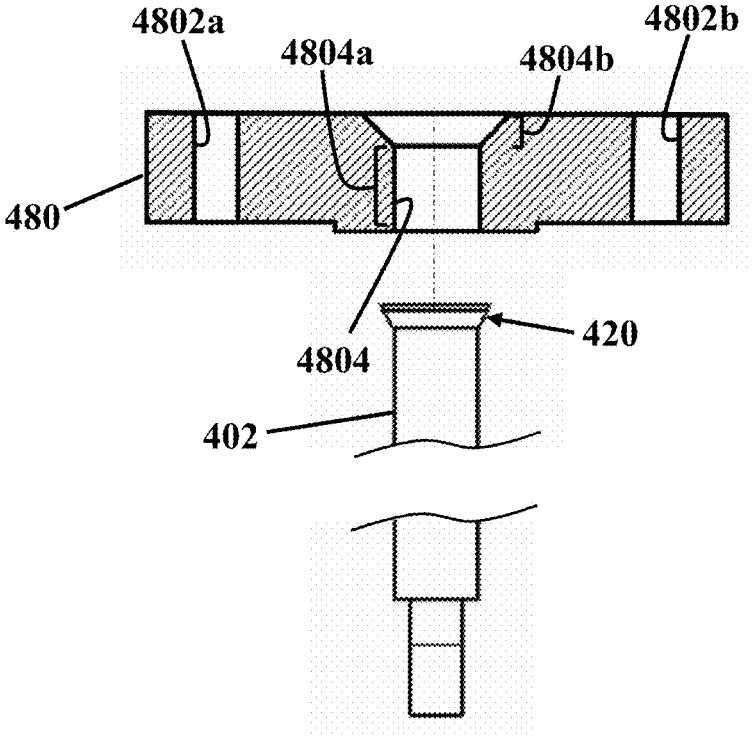
FIG. 4C illustrates an exploded sectional view of a draw punch and a retaining member, consistent with one or more exemplary embodiments of the present disclosure.

FIG. 4C illustrates an exploded sectional view of draw punch 402 and retaining member 480, consistent with one or more exemplary embodiments of the present disclosure. In an exemplary embodiment, retaining member 480 may include a number of screw holes 4802*a-b* that may allow attaching retaining member 480 under upper die shoe 408 by screws 482 that may be fastened into screw holes 4802*a-b* through corresponding screw holes 488*a-b*. In an exemplary embodiment, retaining member 480 may further include a central receiving hole 4804 that may have a straight portion 4804*a* and a retaining trapezoidal portion 4804*b*. In an exemplary embodiment, draw punch 402 may further include a trapezoidal upper end portion 420 that may have a similar shape with retaining trapezoidal portion 4804*b*. In order to attach draw punch 402 under upper die shoe 408, draw punch 402 may first be inserted into central receiving hole 4804 through a corresponding central hole 4810 in upper die shoe 408 and then by fastening retaining member 480 under upper die shoe 408 by screws 482, trapezoidal upper end portion 420 of draw punch 402 may fit into and engage with retaining trapezoidal portion 4804*b* of retaining member 480. In exemplary embodiments, such arrangement of retaining member 480 and draw punch 402 may allow for attaching and fixing draw punch 402 under upper die shoe 408 utilizing retaining member 480.

Figure 4D:
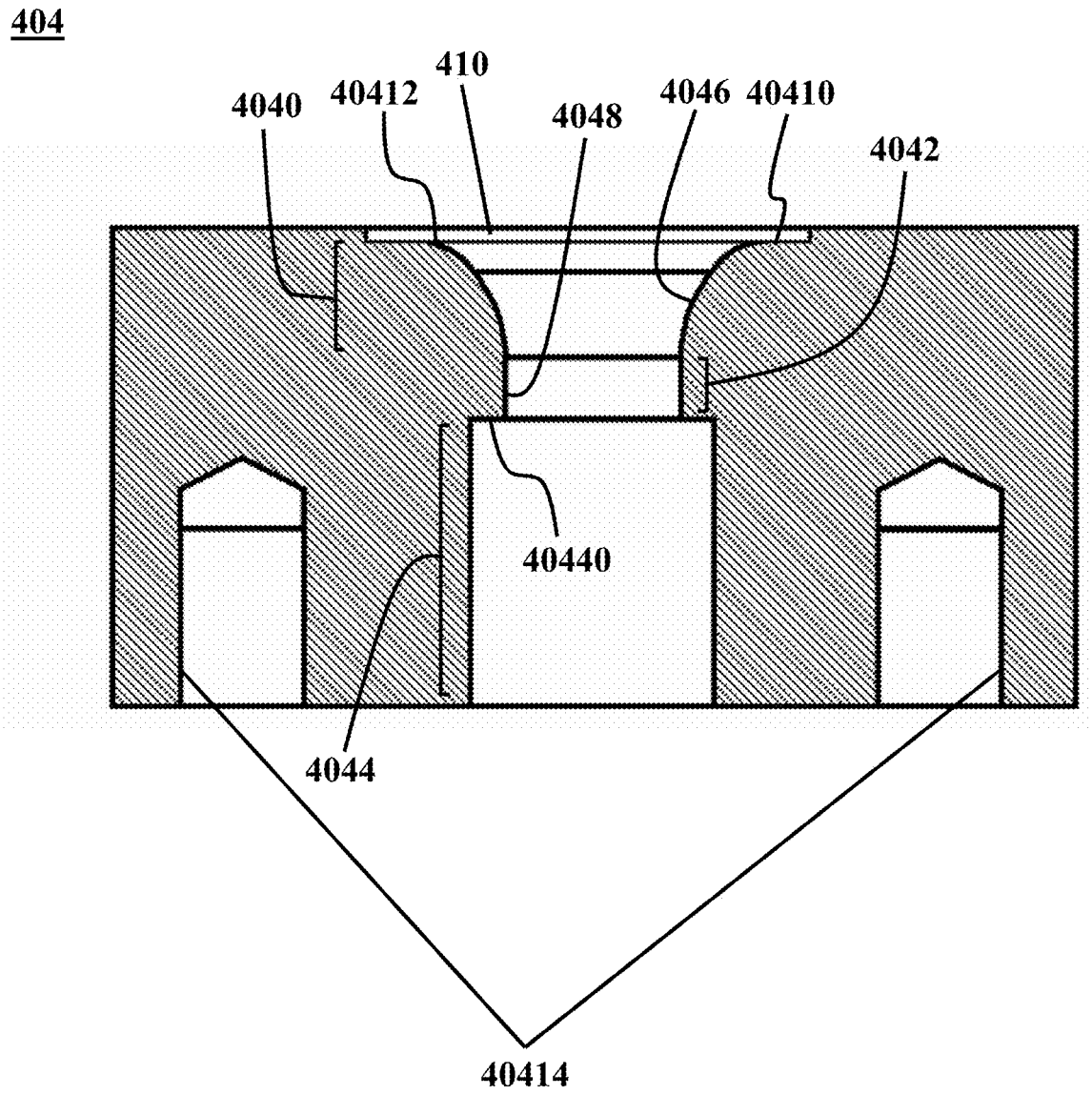
FIG. 4D illustrates a sectional side-view of a draw die, consistent with one or more exemplary embodiments of the present disclosure.

FIG. 4D illustrates a sectional side-view of draw die 404, consistent with one or more exemplary embodiments of the present disclosure. In an exemplary embodiment, draw die 404 may include an upper die cavity 4040 similar to upper die cavity 2040 and a lower die cavity 4042 similar to lower die cavity 2042. Upper die cavity 4040 may include an upper die surface 4046 similar to upper die surface 2046 with a wide flare and lower die cavity 4042 may include a straight vertical surface 4048 similar to straight vertical surface 2048 that may function as an ironing section of draw die 404. In an exemplary embodiment, upper die surface 4046 may include a tractrix flare or surface similar to a tractrix horn.

In an exemplary embodiment, blank material 410 may be a circular plate-like blank that may be placed on an upper die shoulder 40410 encircling an upper opening 40412 of upper die cavity 4040. In an exemplary embodiment, draw punch 402 may be pressed over blank material 410 by a hydraulic press such that draw punch 402 may land on a center of blank material 410. Pressing down draw punch 402 may initially deform blank material 410 to fit blank material 410 into the contour of upper die surface 4046 and assume a cup-like shape under pressure. As draw punch 402 continues to move down, draw punch 402 may further pull blank material 410 through lower die cavity 4042, where straight vertical surface 4048 allows for straightening or ironing sidewalls of cup-shaped blank material 410 to form a cup with straight sidewalls similar to double layer cup-shaped part 300.

In an exemplary embodiment, draw die 404 may further include a stripping section 4044 immediately below lower die cavity 4042. In an exemplary embodiment, stripping section 4044 may include a cylindrical hole concentric with lower die cavity 4042 with a diameter slightly larger than that of lower die cavity 4042 defining a shoulder 40440 between lower die cavity 4042 and stripping section 4044.

Referring to FIGS. 3, 4B, and 4D, in an exemplary embodiment, double layer cup-shaped part 300 may form around draw punch 402 as draw punch 402 passes through lower die cavity 4042 and when draw punch 402 enters stripping section 4044 with a slightly larger dimeter than lower die cavity 4042, double layer cup-shaped part 300 may slightly extend in a radial direction, such that when draw punch 402 is pulled upward, an upper surface 306 of double layer cup-shaped part 300 may engage shoulder 40440 and double layer cup-shaped part 300 may be removed or stripped from draw punch 402 and it may fall out of a central hole 466 in lower die shoe 406 and may later be collected by a user. In an exemplary embodiment, draw die 404 may further include screw holes 40414 that allow for attaching draw die 404 over lower die shoe 406 by screws 460.

EXAMPLE

In an exemplary embodiment an apparatus similar to apparatus 400 was utilized to implement method 100 for fabricating a double layer cup-shaped part similar to double layer cup-shaped part 300.

Figure 5A:
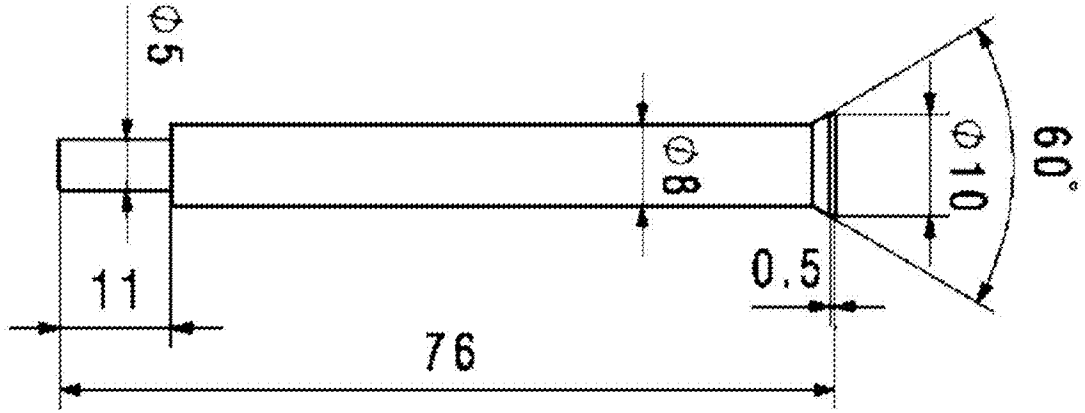
FIG. 5A illustrates dimensions of a draw punch in millimeters, consistent with one or more exemplary embodiments of the present disclosure.
Figure 5B:
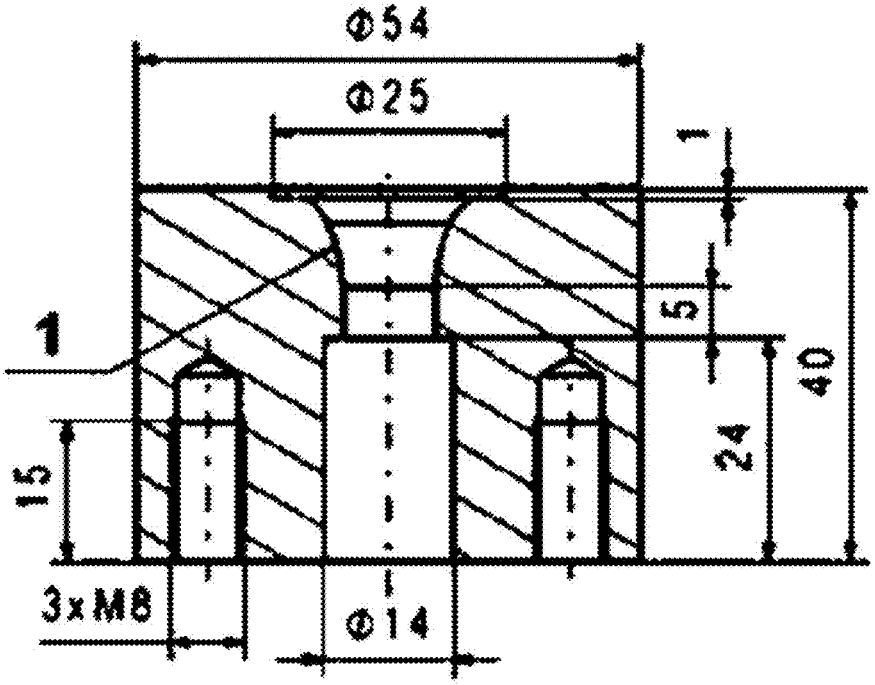
FIG. 5B illustrates dimensions of a draw die in millimeters, consistent with an exemplary embodiment of the present disclosure.
Figure 5C:
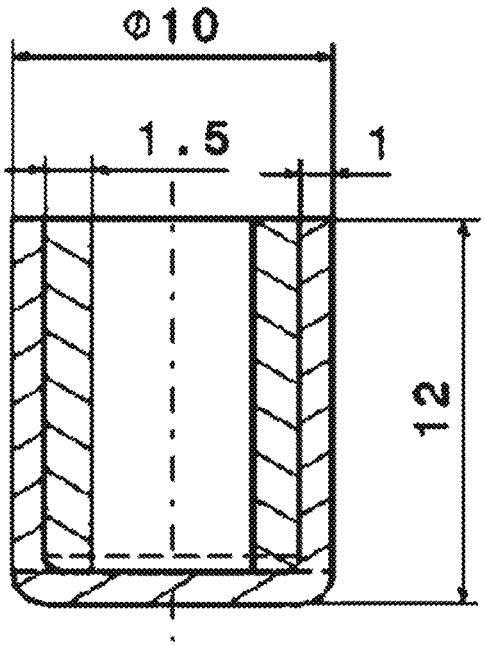
FIG. 5C illustrates dimensions of a fabricated double layer cup-shaped part in millimeters, consistent with one or more exemplary embodiments of the present disclosure.

FIG. 5A illustrates dimensions of a draw punch 502 in millimeters, consistent with one or more exemplary embodiments of the present disclosure. FIG. 5B illustrates dimensions of a draw die 504 in millimeters, consistent with an exemplary embodiment of the present disclosure. FIG. 5C illustrates dimensions of a fabricated double layer cup-shaped part 506 in millimeters, consistent with one or more exemplary embodiments of the present disclosure.

In an exemplary embodiment, draw punch 502 may be similar to draw punch 402, draw die 504 may be similar to draw die 404, and fabricated double layer cup-shaped part 506 may be similar to double layer cup-shaped part 300.

In an exemplary embodiment, a blank material similar to blank material 410 was used to form a cup-shaped outer layer similar to outer cup-shaped layer 304. In an exemplary embodiment, the blank material was a plate-like circular blank made of stainless steel.

In an exemplary embodiment, three different hollow cylinders similar to hollow cylinder 206 were shaped by machining the hollow cylinders out of three formable metals, namely brass, aluminum, and copper. In an exemplary embodiment, double layer cup-shaped part 506 was fabricated by first mounting one of the three hollow cylinders on draw punch 502, placing the blank material over an upper opening of draw die 504, and then pressing down draw punch 502 over the blank material to deep draw the blank material through draw die 502. In exemplary embodiments, the three fabricated double layer cup-shaped parts with similar outer layers of steel and different inner layers of brass, aluminum, and copper were cut longitudinal to investigate the effectiveness of the exemplary drawing process to form the double layer structure of the fabricated part.

Figure 6A:
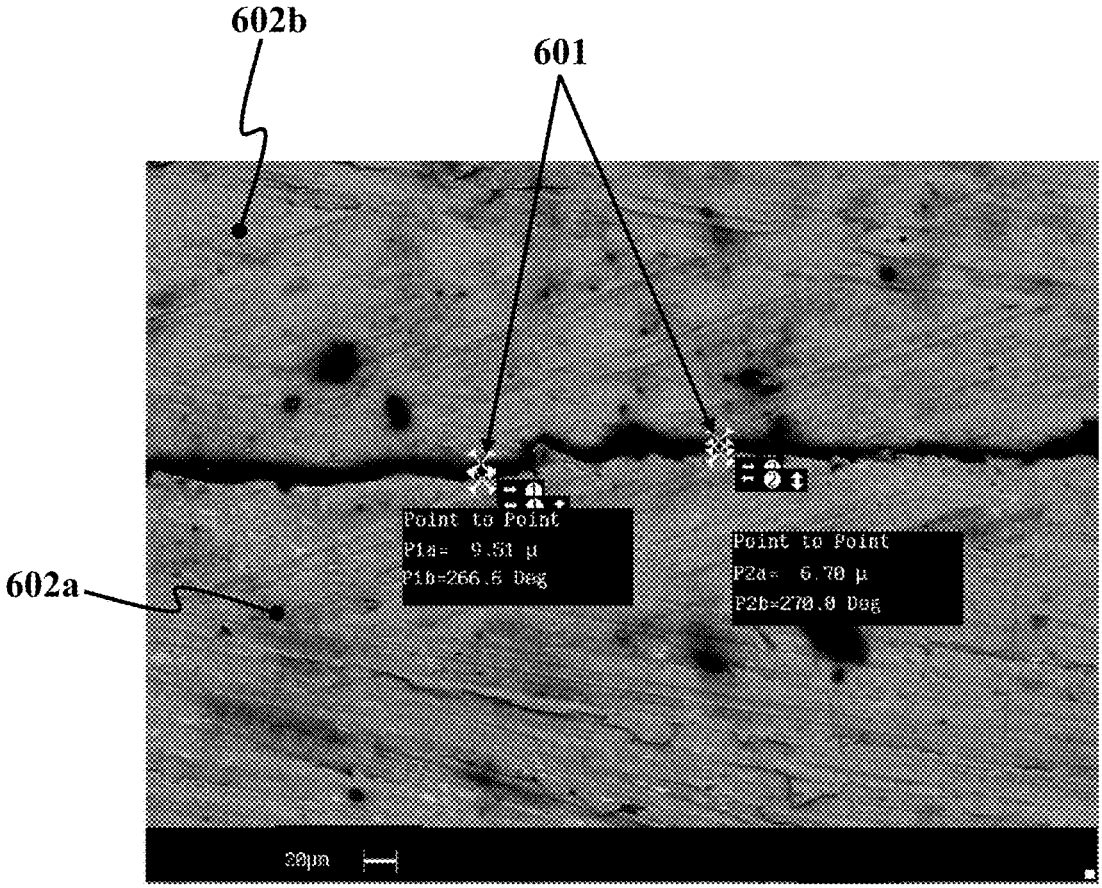
FIG. 6A illustrates scanning electron microscope (SEM) image of a section of a double layer cup-shaped part made of an inner layer of brass and an outer layer of stainless steel, consistent with one or more exemplary embodiments of the present disclosure.
Figure 6B:
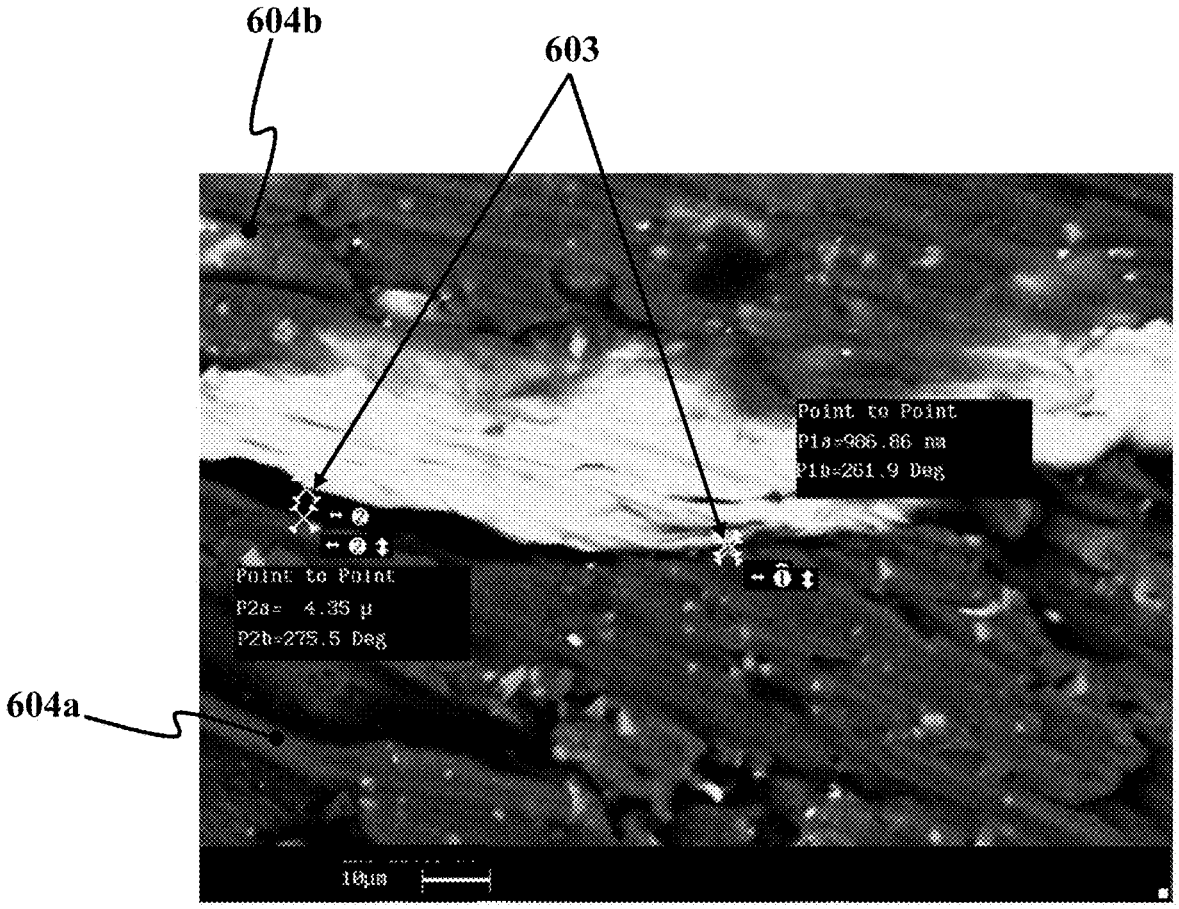
FIG. 6B illustrates SEM image of a section of a double layer cup-shaped part made of an inner layer of aluminum and an outer layer of stainless steel, consistent with one or more exemplary embodiments of the present disclosure.
Figure 6C:
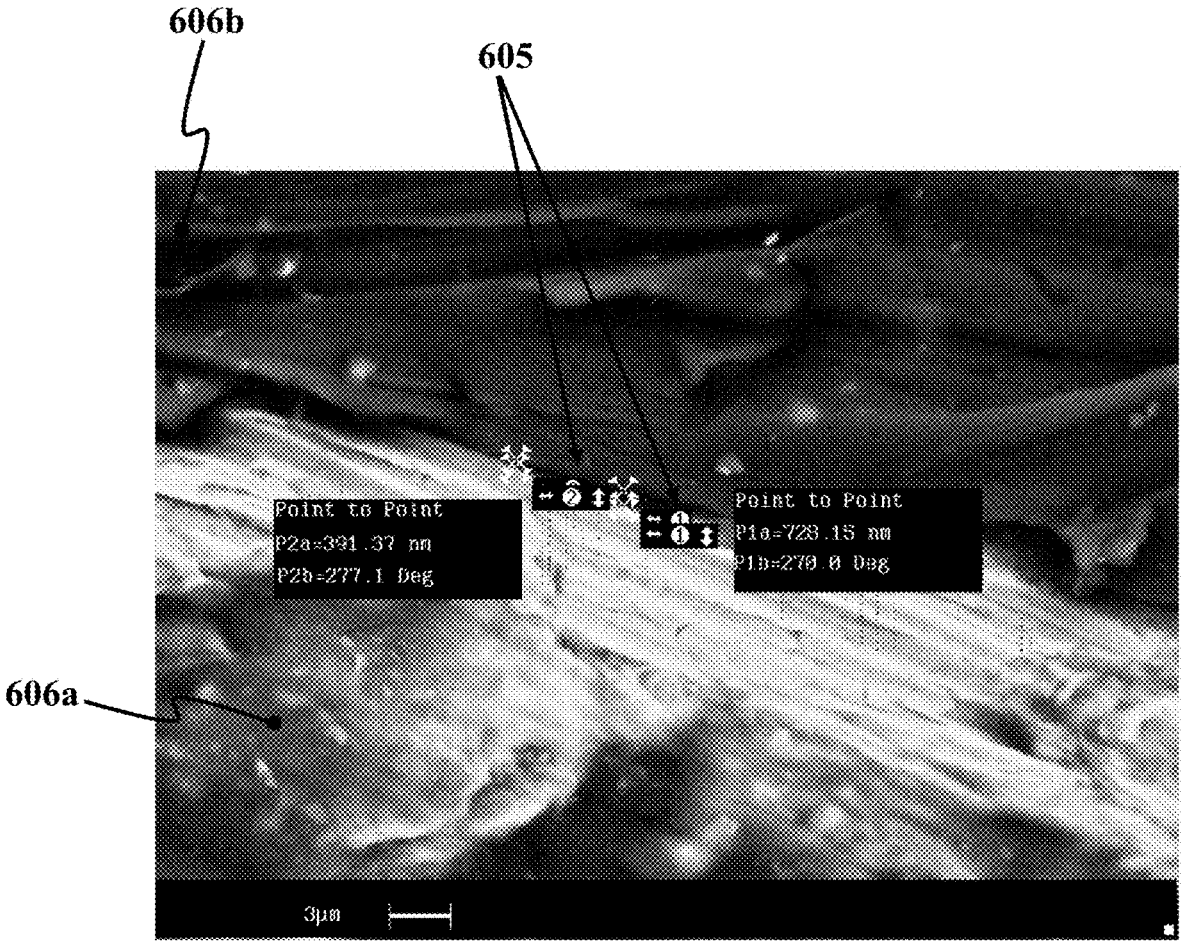
FIG. 6C illustrates SEM image of a section of a double layer cup-shaped part made of an inner layer of copper and an outer layer of stainless steel, consistent with one or more exemplary embodiments of the present disclosure.

FIG. 6A illustrates scanning electron microscope (SEM) image of a section of double layer cup-shaped part 506 made of an inner layer 602*a* of brass and an outer layer 602*b* of stainless steel, consistent with one or more exemplary embodiments of the present disclosure. FIG. 6B illustrates SEM image of a section of double layer cup-shaped part 506 made of an inner layer 604*a* of aluminum and an outer layer 604*b* of stainless steel, consistent with one or more exemplary embodiments of the present disclosure. FIG. 6C illustrates SEM image of a section of double layer cup-shaped part 506 made of an inner layer 606*a* of copper and an outer layer 606*b* of stainless steel, consistent with one or more exemplary embodiments of the present disclosure.

Referring to FIG. 6A, in an exemplary embodiment, it was evident that point-to-point distance 601 between inner layer 602*a* and outer layer 602*b* was between 6.70 micrometer and 9.51 micrometer, which indicated an acceptable attachment between inner layer 602*a* and outer layer 602*b*.

Referring to FIG. 6B, in an exemplary embodiment, it was evident that point-to-point distance 603 between inner layer 604*a* and outer layer 604*b* was between 986.86 nanometer and 4.35 micrometers, which indicated an acceptable attachment between inner layer 604*a* and outer layer 604*b*.

Referring to FIG. 6C, in an exemplary embodiment, it was evident that point-to-point distance 605 between inner layer 606*a* and outer layer 606*b* was between 391.37 nanometer and 728.15 nanometer, which indicated an acceptable attachment between inner layer 606*a* and outer layer 606*b*.

The example above shows that the exemplary method and apparatus may be utilized for fabricating double layer bimetal parts such as bushings, high pressure vessels, and etc. in an effective way. In exemplary embodiments, utilizing a deep drawing process similar to the exemplary methods and devices described in preceding sections may allow for a more cost-effective production of double layer cup-shaped parts.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method for fabricating a double layer cup-shaped part, the method comprising:

shaping a first material into a hollow cylinder;

mounting the hollow cylinder on a draw punch, the draw punch comprising an upper punch portion with a first diameter and a lower punch portion with a second smaller diameter, mounting the hollow cylinder on the draw punch comprising tightly fitting the hollow cylinder around the lower punch portion, the first diameter extending an entire length of the upper punch portion and the second diameter extending an entire length of the lower punch portion; and forming the double layer cup-shaped part by drawing a blank material through a draw die by:

placing the blank material over an upper opening of the draw die; and pressing the draw punch over the blank material, the first material forming an inner layer of the double layer cup-shaped part, the blank material forming an outer cup-shaped layer of the double layer cup-shaped part.

2. The method according to claim 1, wherein shaping the first material into the hollow cylinder comprises shaping the first material into a hollow cylinder with an inner diameter equal to the second smaller diameter.

3. The method according to claim 1, wherein shaping the first material into the hollow cylinder comprises shaping the first material into a hollow cylinder with an outer diameter equal to or less than the first diameter.

4. The method according to claim 1, wherein shaping the first material into the hollow cylinder comprises shaping the first material into a hollow cylinder with a height equal to a height of the lower punch portion.

5. The method according to claim 1, wherein shaping the first material into the hollow cylinder comprises machining the hollow cylinder out of the first material.

6. The method according to claim 1, wherein placing the blank material over the upper opening of the draw die comprises placing the blank material over a draw die with an upper die surface with a wide flare.

7. The method according to claim 1, wherein placing the blank material over the upper opening of the draw die comprises placing the blank material over a draw die with an upper die surface with a tractrix flare.

8. The method according to claim 7, wherein placing the blank material over the upper opening of the draw die comprises placing the blank material over the draw die, the draw die further comprising a straight lower die surface immediately below the upper die surface.

9. The method according to claim 1, wherein shaping the first material into the hollow cylinder comprises shaping a first formable metal into the hollow cylinder, the first formable metal is one of brass, copper, aluminum, and stainless steel.

10. The method according to claim 1, wherein placing the blank material over the upper opening of the draw die comprises placing a second formable metal over the upper opening of the draw die, the second formable metal is one of brass, copper, aluminum, and stainless steel.

11. The method according to claim 1, wherein shaping the first material into the hollow cylinder comprises shaping the first material into the hollow cylinder with a uniform diameter and two open respective ends of the hollow cylinder, one of the two respective configured ends configured to allow the access of the lower punch portion.

* * * * *